US005312272A

United States Patent [19]

Lai

[11] Patent Number: 5,312,272

[45] Date of Patent: May 17, 1994

[54] BNC T-TYPE ADAPTER

[76] Inventor: Yang-Chuan Lai, No. 44, Lane 627, Sec. 5, Chung-Hsin Rd., San-Chung City, Taipei Hsien, Taiwan

[21] Appl. No.: 74,660

[22] Filed: Jun. 10, 1993

[51] Int. Cl.[5] ..... H01R 13/00

[52] U.S. Cl. ..... 439/582

[58] Field of Search ..... 439/578-585

[56] References Cited

U.S. PATENT DOCUMENTS

| | | | |
|---|---|---|---|
| 4,892,491 | 1/1990 | Budaano et al. | 439/582 |
| 5,219,299 | 6/1993 | Wang | 439/582 |
| 5,226,838 | 7/1993 | Hsu | 439/582 |

*Primary Examiner*—Joseph H. McGlynn
*Attorney, Agent, or Firm*—Millen, White, Zelano & Branigan

[57] ABSTRACT

A BNC T-type adapter includes a T-shaped hollow housing with a common branch and left and right branches that extend from two sides of the common branch and that are communicated with the common branch. The common branch has a twist-lock member secured thereon. An internal conductor is disposed in the housing and includes a vertical conductor that extends into the common branch and a horizontal conductor that is connected to the vertical conductor and that has left and right parts which extend respectively into the left and right branches. Two insulator units are sleeved respectively around the left and right parts to position properly the horizontal conductor within the housing. The horizontal conductor further has a plate-like intermediate part provided with a retaining projection that protrudes upwardly therefrom and a pair of rectangular plates that project upwardly from two sides thereof. Each of the rectangular plates is formed with an inwardly and downwardly inclining resilient fin. The vertical conductor has an intermediate section that is clamped between the resilient fins and a lower end that engages the retaining projection.

9 Claims, 4 Drawing Sheets

BNC T-TYPE ADAPTER

BACKGROUND OF THE INVENTION

1. Field of the Invention

The invention relates to a BNC T-type adapter, more particularly to an improved BNC T-Type adapter which can be conveniently and quickly assembled.

2. Description of the Related Art

Referring to FIG. 1, a conventional BNC T-type adapter (1) is shown to comprise a T-shaped hollow housing with a common branch (11) that is provided with a twist-lock member and left and right branches (12, 13) that extend from two sides of the common branch (11) and that are communicated with the same. When a cable connector (2) mates with the twist-lock member, the signals present at the common branch (11) can be received at the left and right branches (12, 13). The adapter (1) can thus be considered as a signal distributor.

The drawback of the conventional adapter (1) is as follows: FIG. 2 is an illustration of an internal conductor (3) of the adapter (1). The internal conductor (3) is made of copper and is shown to include a vertical conductor (31) that extends into the common branch (11) and a horizontal conductor with left and right parts (32, 33) that extend respectively into the left and right branches (12, 13). The vertical conductor (31) has a lowermost end which engages threadably the horizontal conductor at a screw hole (34) that is formed in an intermediate portion of the latter. Thus, engagement between the horizontal and vertical conductors of the internal conductor (3) is a slow and troublesome process, thereby preventing quick and convenient assembly of the adapter (1).

SUMMARY OF THE INVENTION

Therefore, the objective of the present invention is to provide an improved BNC T-Type adapter which can be conveniently and quickly assembled.

Accordingly, the BNC T-type adapter of the present invention comprises:

a T-shaped hollow housing with a common branch and left and right branches that extend from two sides of the common branch and that are communicated with the common branch, the common branch having a twist-lock member secured thereon;

an internal conductor disposed in the housing and including a vertical conductor that extends into the common branch and a horizontal conductor that is connected to the vertical conductor and that has left and right parts which extend respectively into the left and right branches, the horizontal conductor further having a plate-like intermediate part provided with a retaining projection that protrudes upwardly therefrom and a pair of rectangular plates that project upwardly from two sides thereof, each of the rectangular plates being formed with an inwardly and downwardly inclining resilient fin, the vertical conductor having an intermediate section that is clamped between the resilient fins and a lower end that engages the retaining projection; and two insulator units sleeved respectively around the left and right parts to position properly the horizontal conductor within the housing.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
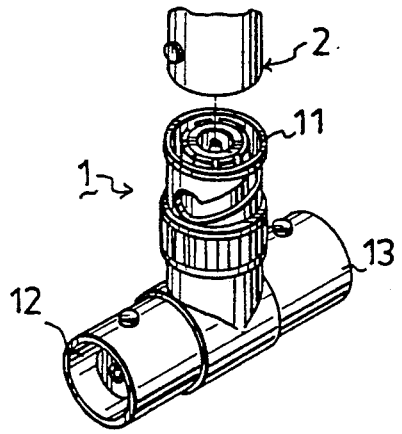
FIG. 1 PRIOR ART
FIG. 1 is a perspective view of a conventional BNC T-type adapter.
Figure 2:
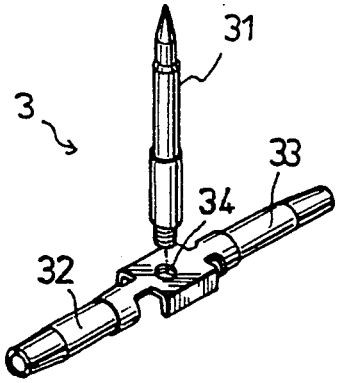
FIG. 2 PRIOR ART
FIG. 2 is an exploded view of an internal conductor of the conventional adapter shown in FIG. 1.
Figure 3:
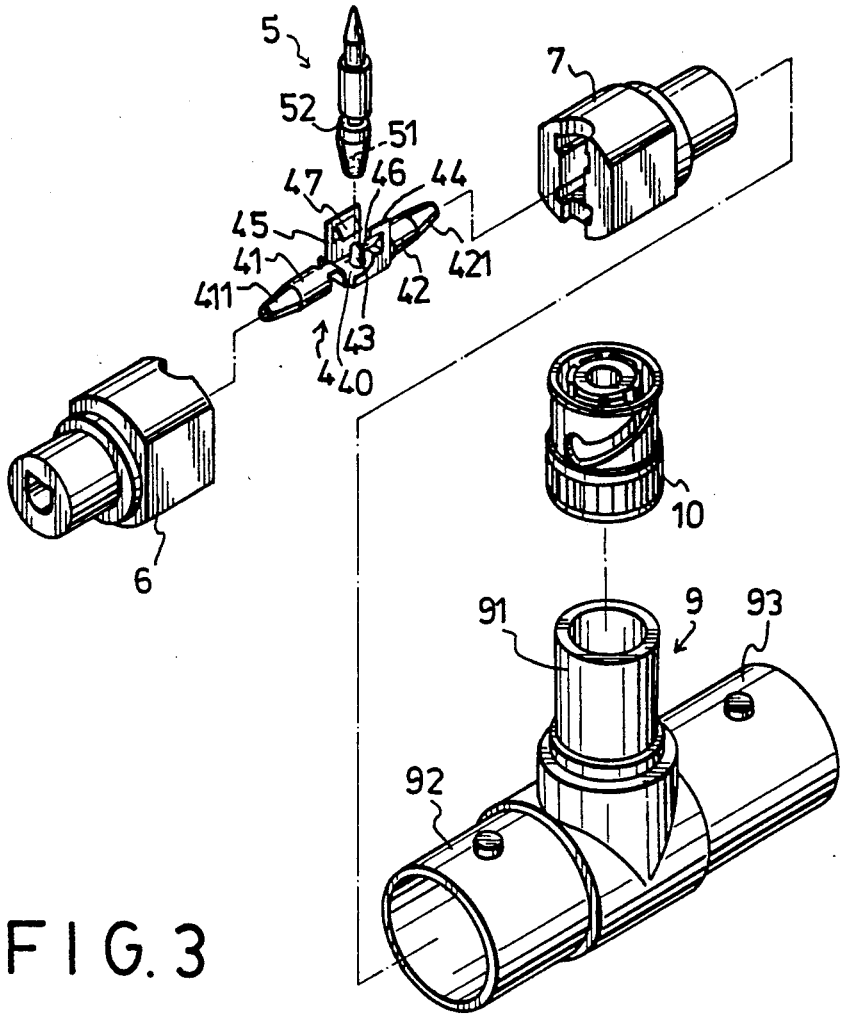
FIG. 3 is an exploded view of the first preferred embodiment of a BNC T-type adapter according to the present invention.

Referring to FIG. 3, the first preferred embodiment of a BNC T-type adapter according to the present invention is shown to comprise a T-shaped hollow housing (9) with a common branch (91) and left and right branches (92, 93) that extend from two sides of the common branch (91) and that are communicated with the same. A twist-lock member (10) is secured on the common branch (91). The adapter further comprises an internal conductor which is disposed inside the housing (9) and which includes a vertical conductor (5) that extends into the common branch (91) and a horizontal conductor (4) that is connected to the vertical conductor (5) and that has left and right parts (41, 42) which extend respectively into the left and right branches (92, 93). Two insulator units (6, 7) are respectively sleeved around the left and right parts (41, 42) so as to position properly the horizontal conductor (4) within the housing (9).

The horizontal conductor (4) has a plate-like intermediate part (40). Each of the left and right parts (41, 42) has a first end connected to a respective end of the intermediate part (40) and a second end provided with a clamping unit (411, 421). In this embodiment, the clamping unit (411, 421) is a tapered tubular unit with four axially split parts and is used to clamp a conductive pin of a cable connector (not shown). A retaining projection (43), such as a cylindrical stud, protrudes upwardly from the intermediate part (40). The intermediate part (40) is further provided with a pair of rectangular plates (44, 45) that project upwardly from two sides thereof. Each of the rectangular plates (44, 45) are punched so as to form an inwardly and downwardly inclining resilient fin (46, 47) thereat.

The vertical conductor (5) is formed as a generally cylindrical rod which has a tapered lower end that is provided with an engaging recess (51) and an intermediate section that is formed with an annular groove (52).

Figure 4:
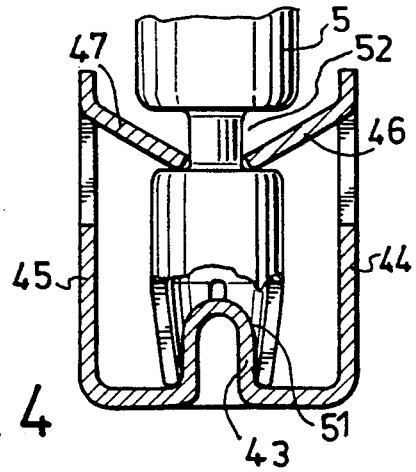
FIG. 4 is an enlarged partly sectional view illustrating the assembly of an internal conductor of the adapter of the present invention.

During assembly, the insulator units (6, 7) are sleeved on the respective one of the left and right parts (41, 42) of the horizontal conductor (4) before installing the latter within the housing (9) such that the left and right parts (41, 42) extend respectively into the left and right branches (92, 93). The tapered lower end of the vertical conductor (5) is then inserted into the common branch (91) of the housing (9) between the resilient fins (46, 47) so that the intermediate section of the vertical conductor (5) is clamped between the resilient fins (46, 47) and so that the engaging recess (51) receives fittingly the retaining projection (43) therein, as shown in FIG. 4. The resilient fins (46, 47) engage the annular groove (52) of the vertical conductor (5) at this stage. Finally, the twist-lock member (10) is secured on the common branch (91) to complete the BNC T-type adapter of the present invention.

Figure 5:
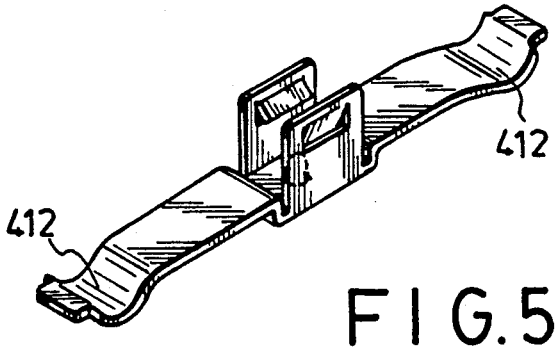
FIG. 5 is a perspective view of a horizontal conductor of an internal conductor of the second preferred embodiment of an adapter according to the present invention.
Figure 6:
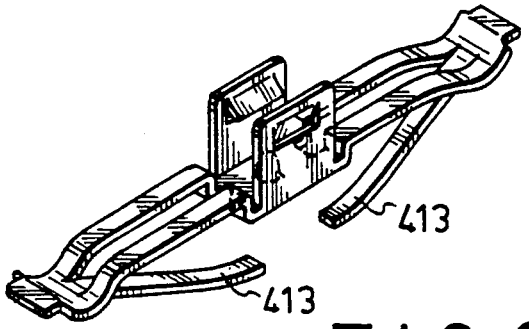
FIG. 6 is a perspective view of a horizontal conductor of an internal conductor of the third preferred embodiment of an adapter according to the present invention.
Figure 7:
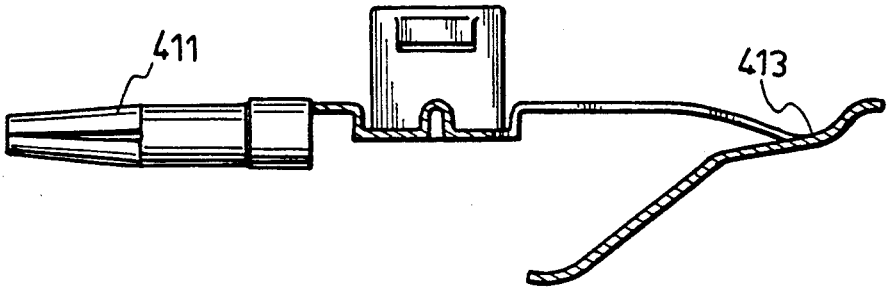
FIG. 7 is a partly sectional view of a horizontal conductor of an internal conductor of the fourth preferred embodiment of an adapter according to the present invention.

Note that the construction of the clamping unit of the left and right parts of the horizontal conductor may be modified so as to suit the intended application. In the second preferred embodiment of an adapter according to the present invention, the clamping unit (412) on each of the left and right parts of the horizontal conductor is a downwardly projecting protrusion that is formed by punching each of the left and right parts, as shown in FIG. 5. In the third preferred embodiment of an adapter according to the present invention, the clamping units (413) are opposed slanted resilient conducting strips which are formed by punching each of the left and right parts of the horizontal conductor, as shown in FIG. 6. In the fourth preferred embodiment of an adapter according to the present invention, the clamping units (411, 413) of the first and third preferred embodiments are provided on the left and right parts of the horizontal conductor, as shown in FIG. 7.

Figure 8:
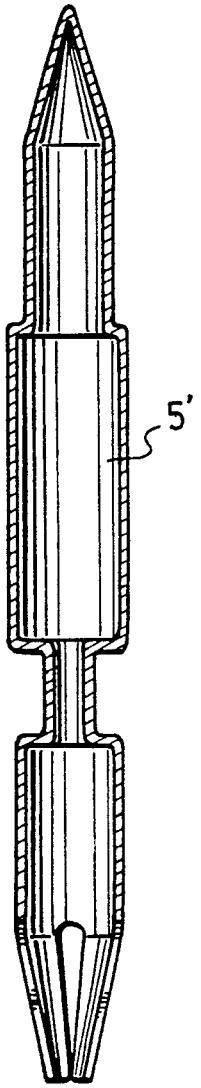
FIG. 8 is a sectional view of a vertical conductor of an internal conductor of the fifth preferred embodiment of an adapter according to the present invention.

FIG. 8 is a sectional view of a vertical conductor (5') of an internal conductor of the fifth preferred embodiment of an adapter according to the present invention. The lower end of the vertical conductor (5') is formed as a tapered tube with axially split parts that engage the retaining projection on the horizontal conductor.

Figure 9:
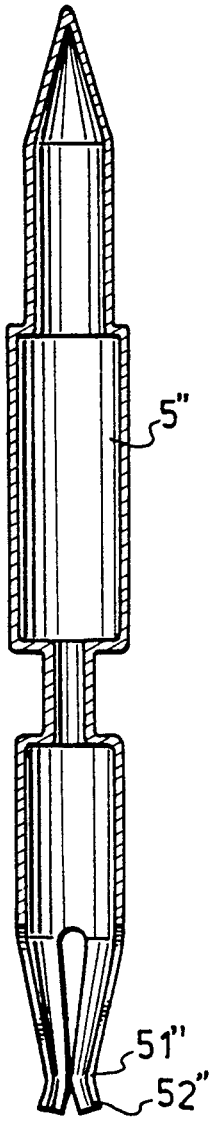
FIG. 9 is a sectional view of a vertical conductor of an internal conductor of the sixth preferred embodiment of an adapter according to the present invention.

FIG. 9 is a sectional view of a vertical conductor (5'') of an internal conductor of the sixth preferred embodiment of an adapter according to the present invention. The lower end of the vertical conductor (5'') is substantially similar to that of the previous embodiment except that the axially split parts of the former form a constricted portion (51'') and an outwardly diverging portion (52'') that extends from the constricted portion (51'').

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A BNC T-type adapter including a T-shaped hollow housing with a common branch and left and right branches that extend from two sides of said common branch and that are communicated with said common branch, said common branch having a twist-lock member secured thereon, an internal conductor disposed in said housing and including a vertical conductor that extends into said common branch and a horizontal conductor that is connected to said vertical conductor and that has left and right parts which extend respectively into said left and right branches, and two insulator units sleeved respectively around said left and right parts to position properly said horizontal conductor within said housing, wherein the improvements comprise:

said horizontal conductor further having a plate-like intermediate part provided with a retaining projection that protrudes upwardly therefrom and a pair of rectangular plates that project upwardly from two sides thereof, each of said rectangular plates being formed with an inwardly and downwardly inclining resilient fin; and said vertical conductor having an intermediate section that is clamped between said resilient fins and a lower end that engages said retaining projection.

2. The BNC T-type adapter as claimed in claim 1, wherein said retaining projection is a cylindrical stud.

3. The BNC T-type adapter as claimed in claim 1, wherein said intermediate section of said vertical conductor is formed with an annular groove which engages said resilient fins.

4. The BNC T-type adapter as claimed in claim 1, wherein said lower end of said vertical conductor is tapered and is formed with an engaging recess that receives fittingly said retaining projection therein.

5. The BNC T-type adapter as claimed in claim 1, wherein said lower end of said vertical conductor is formed as a tapered tube with axially split parts that engage said retaining projection.

6. The BNC T-type adapter as claimed in claim 1, wherein each of said left and right parts has a first end connected to a respective end of said intermediate part and a second end provided with a clamping unit.

7. The BNC T-type adapter as claimed in claim 6, wherein said clamping unit is a tapered tubular unit with a number of axially split parts.

8. The BNC T-type adapter as claimed in claim 6, wherein said clamping unit is a downwardly projecting protrusion that is formed by punching each of said left and right parts.

9. The BNC T-type adapter as claimed in claim 6, wherein said clamping unit is a slanted resilient conducting strip which is formed by punching each of said left and right parts.

* * * * *